US010323863B2

(12) United States Patent
Siegert et al.

(10) Patent No.: US 10,323,863 B2
(45) Date of Patent: Jun. 18, 2019

(54) EJECTOR REFRIGERATION CIRCUIT

(71) Applicants: Carrier Corporation, Farmington, CT (US); Jan Siegert, Mainz-Kostheim (DE)

(72) Inventors: Jan Siegert, Mainz-Kostheim (DE); Heinz Gassen, Cologne (DE)

(73) Assignee: CARRIER KÄLTETECHNIK DEUTSCHLAND GMBH, Cologne (DE)

( * ) Notice: Subject to any disclaimer, the term of this patent is extended or adjusted under 35 U.S.C. 154(b) by 0 days.

(21) Appl. No.: 15/572,979

(22) PCT Filed: May 12, 2015

(86) PCT No.: PCT/EP2015/060455
§ 371 (c)(1),
(2) Date: Nov. 9, 2017

(87) PCT Pub. No.: WO2016/180482
PCT Pub. Date: Nov. 17, 2016

(65) Prior Publication Data
US 2018/0119997 A1 May 3, 2018

(51) Int. Cl.
*F25B 1/10* (2006.01)
*F25B 5/02* (2006.01)
(Continued)

(52) U.S. Cl.
CPC ..... *F25B 9/08* (2013.01); *F25B 1/10* (2013.01); *F25B 5/02* (2013.01); *F25B 9/006* (2013.01);
(Continued)

(58) Field of Classification Search
CPC .... F25B 9/08; F25B 5/02; F25B 9/006; F25B 9/008; F25B 41/00; F25B 2341/0012; F25B 2341/0015; F25B 2400/075
See application file for complete search history.

(56) References Cited

U.S. PATENT DOCUMENTS 6,158,237 A 12/2000 Riffat et al.
6,336,343 B1 1/2002 Nishioka et al.
(Continued)

FOREIGN PATENT DOCUMENTS

CN 103759449 A 4/2014
DE 102008016860 A1 10/2008
(Continued)

OTHER PUBLICATIONS

Cen, Jiwen, et al., "A novel transcritical CO2 refrigeration cycle with two ejectors", International Journal of Refrigersation, 35 (2012), pp. 2233-2239.
(Continued)

*Primary Examiner* — Elizabeth J Martin
(74) *Attorney, Agent, or Firm* — Cantor Colburn LLP

(57) ABSTRACT

An ejector refrigeration circuit, which is configured for circulating a refrigerant, includes at least two controllable ejectors, which are connected in parallel and respectively comprise a primary high pressure input port, a secondary low pressure input port and an output port; and a control unit, which is configured for operating the ejector refrigeration circuit employing a method which includes a) operating a first ejector by controlling the opening of its high pressure port until the maximum efficiency of said first ejector has been reached or the actual refrigeration demands are met; b) operating at least one additional ejector by opening its primary high pressure input port for increasing the refrigeration capacity of the ejector refrigeration circuit in case the
(Continued)

actual refrigeration demands are not met by operating the first ejector alone.

18 Claims, 2 Drawing Sheets

(51) Int. Cl.
*F25B 9/00* (2006.01)
*F25B 9/08* (2006.01)
*F25B 41/00* (2006.01)

(52) U.S. Cl.
CPC ..... *F25B 9/008* (2013.01); *F25B 41/00* (2013.01); *F25B 2341/0012* (2013.01); *F25B 2341/0015* (2013.01); *F25B 2400/075* (2013.01); *F25B 2400/13* (2013.01)

(56) References Cited

U.S. PATENT DOCUMENTS

| | | | | |
|---|---|---|---|---|
| 6,857,286 | B2 | 2/2005 | Ohta et al. | |
| 7,779,647 | B2 | 8/2010 | Takeuchi et al. | |
| 8,776,539 | B2 | 7/2014 | Verma et al. | |
| 9,752,801 | B2 | 9/2017 | Verma et al. | |
| 9,759,462 | B2 | 9/2017 | Zou et al. | |
| 2004/0123624 | A1 | 7/2004 | Ohta et al. | |
| 2010/0313582 | A1 | 12/2010 | Oh et al. | |
| 2011/0203309 | A1* | 8/2011 | Okazaki | F25B 41/00 62/500 |
| 2011/0259039 | A1 | 10/2011 | Ma et al. | |
| 2012/0116594 | A1* | 5/2012 | Aidoun | F25B 1/06 700/276 |
| 2012/0167601 | A1 | 7/2012 | Cogswell et al. | |
| 2013/0111935 | A1* | 5/2013 | Zou | F25B 9/06 62/117 |
| 2013/0111944 | A1* | 5/2013 | Wang | F25B 41/00 62/500 |
| 2016/0138847 | A1* | 5/2016 | Zimmermann | F25D 3/12 62/384 |
| 2017/0261245 | A1* | 9/2017 | Madsen | F25B 41/00 |

FOREIGN PATENT DOCUMENTS

| | | | |
|---|---|---|---|
| EP | 0142209 | B1 | 3/1988 |
| EP | 0859940 | B1 | 10/2002 |
| EP | 1566599 | A2 | 8/2005 |
| EP | 1026461 | B1 | 5/2006 |
| JP | 2010151424 | A * | 7/2010 |

OTHER PUBLICATIONS

International Search Report and Written Opinion for application PCT/EP2015/060455, dated Jan. 20, 2016, 11 pages.

* cited by examiner

EJECTOR REFRIGERATION CIRCUIT

The invention is related to an ejector refrigeration circuit, in particular to an ejector refrigeration circuit comprising at least two controllable ejectors and a method of controlling said ejectors.

Controllable ejectors may be used in refrigeration circuits as high pressure control devices for controlling the high pressure level of a circulating refrigerant by varying the high pressure mass flow of the refrigerant rate through the ejector. The variable high pressure mass flow is controllable by the ejector opening degree and can be adjusted between zero and one hundred percent. An ejector additionally may operate as a so called ejector pump for compressing refrigerant from a low pressure level to a medium pressure level using energy that becomes available when expanding the refrigerant from a high pressure level to the medium pressure level.

Accordingly, it would be beneficial to optimize the efficiency of an ejector refrigeration circuit for any given overall high pressure mass flow.

Exemplary embodiments of the invention include a method of operating an ejector refrigeration circuit with at least two controllable ejectors connected in parallel and respectively comprising a controllable primary high pressure input port, a secondary low pressure input port and a medium pressure output port, wherein the method comprises the steps of:

a) operating a first ejector of the at least two controllable ejectors by controlling the opening degree of its controllable primary high pressure input port until the maximum efficiency of said first ejector has been reached or the actual refrigeration demands are met;

b) operating at least one additional ejector of the at least two controllable ejectors by opening its controllable primary high pressure input port for increasing the refrigeration capacity of the ejector refrigeration circuit in case the actual refrigeration demands are not met by operating the first ejector alone.

Exemplary embodiments of the invention also include an ejector refrigeration circuit, which is configured for circulating a refrigerant, in particular carbon dioxide, and comprises:

at least two controllable ejectors connected in parallel and respectively comprising a controllable primary high pressure input port, a secondary low pressure input port and a medium pressure output port; and a control unit, which is configured for operating the ejector refrigeration circuit employing a method comprising the steps of:

a) operating a first ejector of the at least two controllable ejectors by controlling the opening degree of its controllable high pressure port until the maximum efficiency of said first ejector has been reached or the actual refrigeration demands are met;

b) operating at least one additional ejector of the at least two controllable ejectors by opening its controllable primary high pressure input port for increasing the refrigeration capacity of the ejector refrigeration circuit in case the actual refrigeration demands are not met by operating the first ejector alone.

The efficiency of an individual ejector is a function of the high pressure mass flow rate while the overall high pressure mass flow, i.e. the mass flow through all ejectors, is given as a control input via the needed high pressure drop. In order to cope with part load operation an ejector refrigeration circuit according to exemplary embodiments of the invention is equipped with at least two controllable ejectors, which are configured for working in parallel.

Operating an ejector refrigeration circuit comprising at least two controllable ejectors according to exemplary embodiments of the invention allows to operate the ejector refrigeration circuit very stable and efficiently, as it reliably avoids to operate any of the controllable ejectors in a range of operation in which its operation is less efficient. This results in an optimized efficiency of the ejector refrigeration circuit over a wide range of operational conditions.

SHORT DESCRIPTION OF THE FIGURES

An exemplary embodiment of the invention will be described in the following with respect to the enclosed Figures.

DETAILED DESCRIPTION OF THE FIGURES

Figure 1:
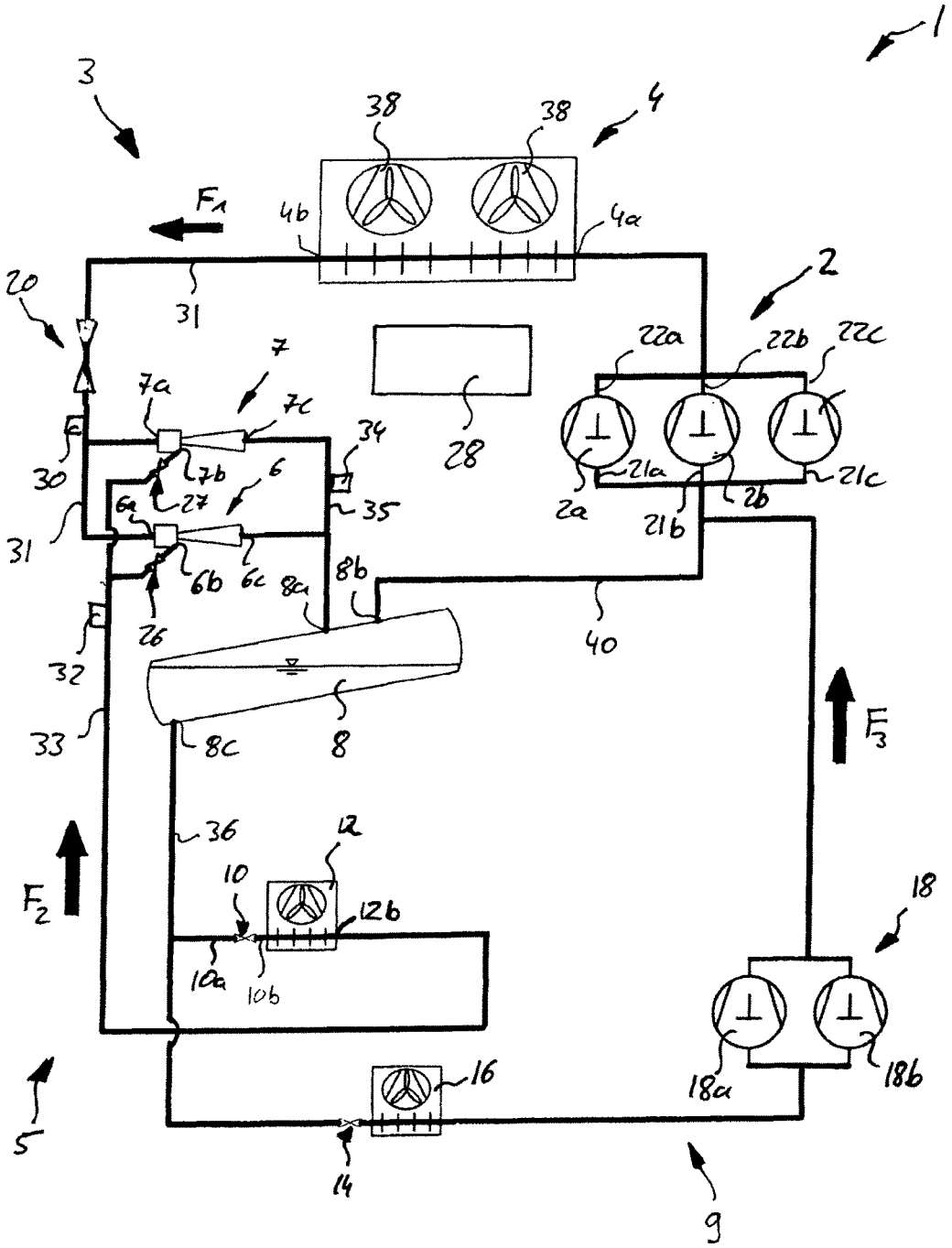
FIG. 1 illustrates a schematic view of an ejector refrigeration circuit according to an exemplary embodiment of the invention.

FIG. 1 illustrates a schematic view of an ejector refrigeration circuit 1 according to an exemplary embodiment of the invention comprising a high pressure ejector circuit 3, a refrigerating evaporator flowpath 5, and a low temperature flowpath 9 respectively circulating a refrigerant as indicated by the arrows $F_1$, $F_2$, and $F_3$.

The high pressure ejector circuit 3 comprises a compressor unit 2 including a plurality of compressors 2*a*, 2*b*, 2*c* connected in parallel.

The high pressure side outlets 22*a*, 22*b*, 22*c* of said compressors 2*a*, 2*b*, 2*c* are fluidly connected to an outlet manifold collecting the refrigerant from the compressors 2*a*, 2*b*, 2*c* and delivering the refrigerant via a heat rejection heat exchanger/gas cooler inlet line to the inlet side 4*a* of a heat rejecting heat exchanger/gas cooler 4. The heat rejecting heat exchanger/gas cooler 4 is configured for transferring heat from the refrigerant to the environment for reducing the temperature of the refrigerant. In the exemplary embodiment shown in FIG. 1, the heat rejecting heat exchanger/gas cooler 4 comprises two fans 38 which are operable for blowing air through the heat rejecting heat exchanger/gas cooler 4 in order to enhance the transfer of heat from the refrigerant to the environment. Of course, the fans 38 are optional and their number may be adjusted to the actual needs.

The cooled refrigerant leaving the heat rejecting heat exchanger/gas cooler 4 at its outlet side 4*b* is delivered via a high pressure input line 31 comprising a service valve 20 to primary high pressure inlet ports 6*a*, 7*a* of two controllable ejectors 6, 7, which are connected in parallel and configured for expanding the refrigerant to a reduced pressure level. The service valve 20 allows to shut down the flow of refrigerant to the primary high pressure input ports 6*a*, 7*a* in case an ejector 6, 7 needs to be maintained or replaced.

Details of the controllable ejectors 6, 7 will be described further below with reference to FIG. 2.

The expanded refrigerant leaves the controllable ejectors 6, 7 through respective ejector output ports 6*c*, 7*c* and is delivered by means of an ejector output line 35 to o an inlet 8*a* of a receiver 8. Within the receiver 8, the refrigerant is separated by gravity into a liquid portion collecting at the bottom of the receiver 8 and a gas phase portion collecting in an upper part of the receiver 8.

The gas phase portion of the refrigerant leaves the receiver 8 through a receiver gas outlet 8*b* provided at the top of the receiver 8. Said gas phase portion is delivered via a receiver gas outlet line 40 to the inlet sides 21*a*, 22*b*, 22*c* of the compressors 2*a*, 2*b*, 2*c*, which completes the refrigerant cycle of the high pressure ejector circuit 3.

Refrigerant from the liquid phase portion of the refrigerant collecting at the bottom of the receiver 8 exits from the receiver 8 via a liquid outlet 8*c* provided at the bottom of the receiver 8 and is delivered through a receiver liquid outlet line 36 to the inlet side 10*a* of a refrigeration expansion device 10 ("medium temperature expansion device") and, optionally, to a low temperature expansion device 14.

After having left the refrigeration expansion device 10, where it has been expanded, via its outlet side 10*b*, the refrigerant enters into a refrigeration evaporator 12 ("medium temperature evaporator"), which is configured for operating at "normal" cooling temperatures, in particular in a temperature range of −10° C. to +5° C., for providing medium temperature refrigeration.

After having left the refrigeration evaporator 12 via its outlet 12*b*, the refrigerant flows through a low pressure inlet line 33 to the inlet sides of two ejector inlet valves 26, 27. The outlet sides of said ejector inlet valves 26, 27, which preferably are provided as non-adjustable shut-off valves, are respectively connected to the secondary low pressure inlet ports 6*b*, 7*b* of the controllable ejectors 6, 7. In case the respective ejector inlet valve 26, 27 is open, the refrigerant leaving the refrigeration evaporator 12 is sucked into the associated controllable ejector 6, 7 by means of the high pressure flow entering via the respective ejector's 6, 7 primary high pressure inlet port 6*a*, 7*a*. This functionality of the controllable ejectors 6, 7 providing an ejector pump will be described in more detail below with reference to FIG. 2.

The portion of the liquid refrigerant that has been delivered to and expanded by the optional low temperature expansion device 14 enters into an optional low temperature evaporator 16, which in particular is configured for operating at low temperatures in particular at temperatures in the range of −40° C. to −25° C. After having left the low temperature evaporator 16 the refrigerant is delivered to the inlet side of a low temperature compressor unit 18 comprising one or more, in the embodiment shown in FIG. 1 two, low temperature compressors 18*a*, 18*b*.

In operation, the low temperature compressor unit 18 compresses the refrigerant supplied by the low temperature evaporator 16 to medium pressure, i.e. basically the same pressure as the pressure of the refrigerant which is delivered from the gas outlet 8*b* of the receiver 8. The compressed refrigerant is supplied together with the refrigerant provided from the gas outlet 8*b* of the receiver 8 to the inlet sides 21*a*, 21*b*, 21*c* of the compressors 2*a*, 2*b*, 2*c*.

Sensors 30, 32, 34 which are configured for measuring the pressure and/or the temperature of the refrigerant are respectively provided at the high pressure input line 31 fluidly connected to the primary high pressure input ports 6*a*, 7*a* of the controllable ejectors 6, 7, the low pressure input line 33 fluidly connected to the secondary low pressure input ports 6*b*, 7*b* and the output line 35 fluidly connected to the ejector output ports 6*c*, 7*c*. A control unit 28 is configured for controlling the operation of the ejector refrigeration circuit 1, in particular the operation of the compressors 2*a*, 2*b*, 2*b*, 18*a*, 18*b*, the controllable ejectors 6, 7 and the controllable valves 26, 27 provided at the secondary low pressure input ports 6*b*, 7*b* of the controllable ejectors 6, 7 based on the pressure value(s) and/or the temperature value(s) provided by the sensors 30, 32, 34 and the actual refrigeration demands.

In a first mode of operation, when the refrigeration demands and/or the ambient temperature at the heat rejecting heat exchanger/gas cooler 4 are relatively low, only a single (first) ejector 6 of the controllable ejectors 6, 7 is operated, while both, the primary high pressure inlet port 7*a* and the low pressure inlet valve 27 of the second ejector 7 are closed. With increasing refrigeration demands and/or increasing ambient temperatures at the heat rejecting heat exchanger/gas cooler 4 the primary high pressure inlet port 6*a* of the first controllable ejector 6 is gradually opened until the actual refrigeration demands are met or the optimal point of operation of the first controllable ejector 6 is reached. In case the optimal point of operation of the first controllable ejector 6 is reached before the actual refrigeration demands are met, the primary high pressure inlet port 7*a* of the second controllable ejector 7 is additionally opened for increasing the refrigeration capacity of the ejector refrigeration circuit 1 in order to meet the increased refrigeration demands without operating the first controllable ejector 6 beyond its optimal point of operation.

Even when the primary high pressure inlet port 7*a* of the second controllable ejector 7 is opened, the associated low pressure inlet valve 27 may remain closed for operating the second controllable ejector 7 as a high pressure bypass valve bypassing the first controllable ejector 6. When the opening degree of the primary high pressure inlet port 7*a* has reached a point allowing the second controllable ejector 7 to run stable and efficiently, the low pressure inlet valve 27 of said second controllable ejector 7 may be opened for increasing the flow of refrigerant flowing through the refrigeration expansion device 10 and the refrigeration evaporator 12.

Although only two controllable ejectors 6, 7 are shown in FIG. 1, it is self-evident that the invention may be applied similarly to ejector refrigeration circuits comprising three ore more controllable ejectors 6, 7 connected in parallel. The controllable ejectors 6, 7 may have the same capacity or different capacities. In particular, the capacity of the second ejector 7 may be twice as large as the capacity of the first ejector 6, the capacity of an optional third ejector (not shown) may be twice as large as the capacity of the second ejector 7 etc. Such an ejector configuration provides a wide range of available capacities by allowing to selectively operate a suitable combination of controllable ejectors 6, 7.

In case a plurality of controllable ejectors 6, 7 having the same capacity are provided, every ejector 6, 7 alternately may be used as the first ejector 6, i.e. as the ejector 6 operated alone at low refrigeration demands and/or low ambient temperatures. This will result in a uniform wear of the controllable ejectors 6, 7 reducing the costs for maintenance.

In case the controllable ejectors 6, 7 are provided with different capacities, any from the plurality of controllable ejectors 6, 7 may be selected to operate alone acting as the "first ejector" based on the actual refrigeration demands and/or ambient temperatures in order to enhance the efficiency of the ejector refrigeration circuit by using the controllable ejector 6, 7 which may be operated closest to its optimal point of operation.

Figure 2:
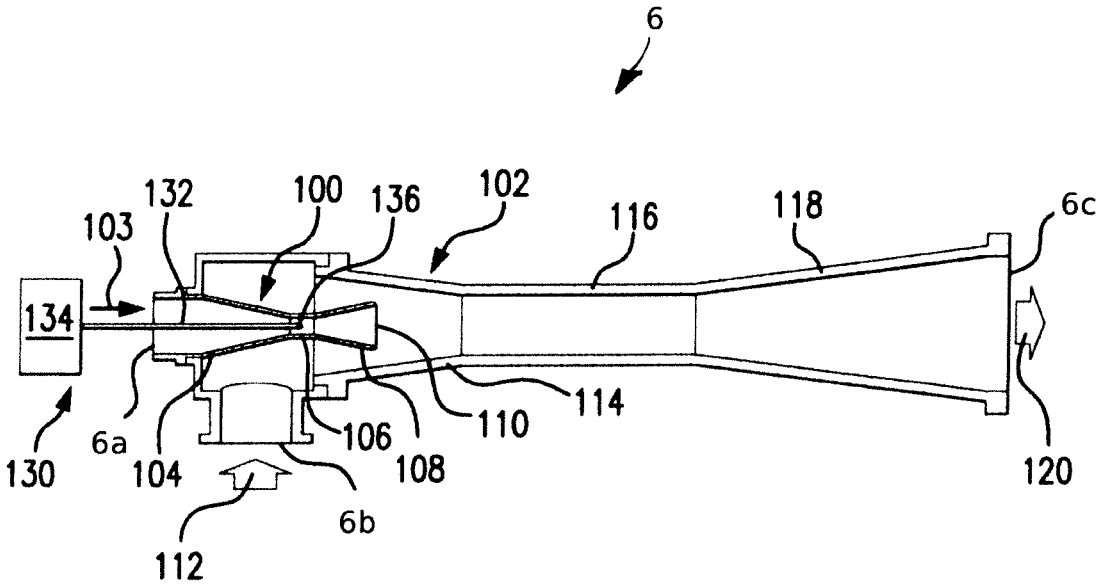
FIG. 2 illustrates a schematic sectional view of a controllable ejector as it may be employed in the exemplary embodiment shown in FIG. 1.

FIG. 2 illustrates a schematic sectional view of an exemplary embodiment of a controllable ejector 6 as it may be employed as each of the controllable ejectors 6, 7 in the ejector refrigeration circuit 1 shown in FIG. 1.

The ejector 6 is formed by a motive nozzle 100 nested within an outer member 102. The primary high pressure inlet port 6*a* forms the inlet to the motive nozzle 100. The ejector output port 6*c* is the outlet of the outer member 102. A primary refrigerant flow 103 enters via the primary high pressure inlet port 6*a* and then passes into a convergent section 104 of the motive nozzle 100. It then passes through a throat section 106 and a divergent expansion section 108 to an outlet 110 of the motive nozzle 100. The motive nozzle 100 accelerates the flow 103 and decreases the pressure of the flow. The secondary low pressure inlet port 6*b* forms an inlet of the outer member 102. The pressure reduction caused to the primary flow by the motive nozzle draws a secondary flow 112 from the secondary low pressure inlet port 6*b* into the outer member 102. The outer member 102 includes a mixer having a convergent section 114 and an elongate throat or mixing section 116. The outer member 102 also has a divergent section ("diffuser") 118 downstream of the elongate throat or mixing section 116. The motive nozzle outlet 110 is positioned within the convergent section 114. As the flow 103 exits the outlet 110, it begins to mix with the secondary flow 112 with further mixing occurring through the mixing section 116 providing a mixing zone. Thus, respective primary and secondary flowpaths respectively extend from the primary high pressure inlet port 6*a* and the secondary low pressure inlet port 6*b* to the ejector output port 6*c*, merging at the exit.

In operation, the primary flow 103 may be supercritical upon entering the ejector 6 and subcritical upon exiting the motive nozzle 100. The secondary flow 112 may be gaseous or a mixture of gas comprising a smaller amount of liquid upon entering the secondary low pressure inlet port 6*b*. The resulting combined flow 120 is a liquid/vapor mixture and decelerates and recovers pressure in the diffuser 118 while remaining a mixture.

The exemplary ejectors 6, 7 employed in exemplary embodiments of the invention are controllable ejectors. Their controllability is provided by a needle valve 130 having a needle 132 and an actuator 134. The actuator 134 is configured for shifting a tip portion 136 of the needle 132 into and out of the throat section 106 of the motive nozzle 100 for modulating the flow through the motive nozzle 100 and, in turn, the ejector 6 overall. Exemplary actuators 134 are electric, e.g. solenoid or the like. The actuator 134 is coupled to and controlled by the control unit 28. The control unit 28 may be coupled to the actuator 134 and other controllable system components via hardwired or wireless communication paths. The control unit 28 may include one or more of: processors; memory (e.g., for storing program information for execution by the processor to perform the operational methods and for storing data used or generated by the program(s)); and hardware interface devices (e.g., ports) for interfacing with input/output devices and controllable system components.

Further Embodiments

A number of optional features are set out in the following. These features may be realized in particular embodiments, alone or in combination with any of the other features.

In an embodiment the method includes gradually opening the primary high pressure input port of at least one additional controllable ejector in order to adjust the mass flow through the additional controllable ejector to the actual refrigeration demands. Gradually opening the primary high pressure input port allows for an exact adjustment of the mass flow through the additional controllable ejector.

In an embodiment the method further includes operating at least one of the controllable ejectors with its secondary low pressure input port being closed. A controllable valve, which is preferably provided in the form of a non-adjustable shut-off valve, may be provided upstream the secondary low pressure input port of at least one/each of the controllable ejectors. Such a controllable valve allows to close the respective ejector's secondary low pressure input port for running at least of the controllable ejectors as a bypass high pressure control valve increasing the mass flow of the refrigerant through the heat rejecting heat exchanger/gas cooler in case said ejector would not run stable and efficient with its secondary low pressure input port being open.

In an embodiment the method further includes opening the secondary low pressure input port of the at least one ejector, which has been operated with its secondary low pressure input port being closed, for increasing the mass flow of the refrigerant through the heat rejecting heat exchanger(s) to meet the actual refrigeration demands.

In an embodiment the method further includes the step of closing the primary high pressure input port and/or the secondary low pressure input port of the first ejector in case the ejector refrigeration circuit is operated more efficiently by running only at least one of the additional controllable ejectors.

In an embodiment the method further includes using carbon dioxide as refrigerant, which provides an efficient and safe, i.e. non-toxic, refrigerant.

In an embodiment the ejector refrigeration circuit further comprises:

- a heat rejecting heat exchanger/gas cooler having an inlet side and an outlet side, wherein the outlet side of the heat rejecting heat exchanger/gas cooler is fluidly connected to the primary high pressure input ports of the controllable ejectors;
- a receiver, having a liquid outlet, a gas outlet and an inlet, which is fluidly connected to the outlet ports of the controllable ejectors;
- at least one compressor having an inlet side and an outlet side, the inlet side of the at least one compressor being fluidly connected to the gas outlet of the receiver, and the outlet side of the at least one compressor being fluidly connected to the inlet side of the heat rejecting heat exchanger/gas cooler;
- at least one refrigeration expansion device having an input side, which is fluidly connected to the liquid outlet of the receiver, and an outlet side; and
- at least one refrigeration evaporator, which is fluidly connected between the outlet side of the at least one refrigeration expansion device and the secondary low pressure input ports of the controllable ejectors.

In an embodiment all of the controllable ejectors are provided with the same capacity. This allows to freely choose between the controllable ejectors and in particular allows to distribute the time of operation equally between the controllable ejectors for causing an even wear of the controllable ejectors.

In an alternative embodiment the controllable ejectors are provided with different capacities allowing to cover a wide range of operational conditions by operating a selected combination of the controllable ejectors. The controllable ejectors in particular may be provided with doubled capacity ratios, i.e. 1:2:4:8. . . , in order to cover a wide range of possible capacities.

In an embodiment at least one sensor, which is configured for measuring the pressure and/or the temperature of the refrigerant, is provided in at least one of a high pressure input line fluidly connected to the primary high pressure input ports, a low pressure input line fluidly connected to the secondary low pressure input ports and an output line fluidly connected to the output ports of the controllable ejectors, respectively. Such sensors allow to optimize the operation of the controllable ejectors based on the pressure value(s) and/or temperature value(s) provided by the sensor(s).

In an embodiment at least one service valve is provided upstream of the controllable ejectors' primary high pressure input ports for allowing to shut down the flow of refrigerant to the primary high pressure input ports in case an ejector needs to be maintained or replaced.

In an embodiment the ejector refrigeration circuit further comprises at least one low temperature circuit which is configured for providing low cooling temperatures in addition to the medium cooling temperatures provided by the refrigerating evaporator flowpath. The low temperature circuit is connected between the liquid outlet of the receiver and the inlet side of the at least one compressor and comprises in the direction of flow of the refrigerant: at least one low temperature expansion device, at least one low temperature evaporator, and at least one low temperature compressor.

While the invention has been described with reference to exemplary embodiments, it will be understood by those skilled in the art that various changes may be made and equivalence may be substitute for elements thereof without departing from the scope of the invention. In particular, modifications may be made to adapt a particular situation or material to the teachings of the invention without departing from the essential scope thereof. Therefore, it is intended that the invention is not limited to the particular embodiments disclosed, but that the invention will include all embodiments falling within the scope of the pending claims.

REFERENCE NUMERALS

1 ejector refrigeration circuit
2 compressor unit
2*a*, 2*b*, 2*c* compressors
3 high pressure ejector circuit
4 heat rejecting heat exchanger/gas cooler
4*a* inlet side of the heat rejecting heat exchanger/gas cooler
4*b* outlet side of the heat rejecting heat exchanger/gas cooler
5 refrigerating evaporator flowpath
6 first controllable ejector
6*a* primary high pressure inlet port of the first controllable ejector
6*b* secondary low pressure inlet port of the first controllable ejector
6*c* output port of the first controllable ejector
7 second controllable ejector
7*a* primary high pressure inlet port of the second controllable ejector
7*b* secondary low pressure inlet port of the second controllable ejector
7*c* outlet of the second controllable ejector
8 receiver
8*a* inlet of the receiver
8*b* gas outlet of the receiver
8*c* liquid outlet of the receiver
9 low temperature flowpath
10 refrigeration expansion device
10*a* inlet side of the refrigeration expansion device
10*b* outlet side of the refrigeration expansion device
12 refrigeration evaporator
12*b* outlet of the refrigeration evaporator
14 low temperature expansion device
16 low temperature evaporator
18 low temperature compressor unit
18*a*, 18*b* low temperature compressors
20 service valve
21*a*, 21*b*, 21*c* inlet side of the compressors
22*a*, 22*b*, 22*c* outlet side of the compressors
26, 27 controllable valves at the secondary low pressure input ports
28 control unit
30 pressure and/or temperature sensor
31 high pressure input line
32 pressure and/or temperature sensor
33 low pressure input line
34 pressure and/or temperature sensor
35 ejector output line
36 receiver liquid outlet line
38 fan of the heat rejecting heat exchanger/gas cooler
40 receiver gas outlet line
100 motive nozzle
102 outer member
103 primary refrigerant flow
104 convergent section of the motive nozzle
106 throat section
108 divergent expansion section
110 outlet of the motive nozzle
112 secondary flow
114 convergent section of the mixer
116 throat or mixing section
118 diffuser
120 combined flow
130 needle valve
132 needle
134 actuator

The invention claimed is:

1. A method of operating an ejector refrigeration circuit with at least two controllable ejectors connected in parallel and respectively comprising a controllable motive nozzle, a primary high pressure input port forming an inlet to the controllable motive nozzle, a secondary low pressure input port and an output port, a heat rejecting heat exchanger/gas cooler having an inlet side and an outlet side, the outlet side of the heat rejecting heat exchanger/gas cooler being fluidly connected to the primary high pressure input ports of the ejectors;

a receiver, having a liquid outlet, a gas outlet and an inlet, which is fluidly connected to the outlet ports of the controllable ejectors; and at least one compressor having an inlet side and an outlet side, the inlet side of the at least one compressor being fluidly connected to the gas outlet of the receiver, and the outlet side of the at least one compressor being fluidly connected to the inlet side of the heat rejecting heat exchanger/gas cooler;

wherein the method comprises:

a) operating a first ejector of the at least two controllable ejectors by controlling the opening degree of its primary high pressure input port until the maximum efficiency of said first ejector has been reached or the actual refrigeration demands are met;

b) operating a second ejector of the at least two controllable ejectors by gradually opening its primary high pressure input port for increasing the refrigeration capacity of the ejector refrigeration circuit in case the actual refrigeration demands are not met by operating the first ejector alone.

2. The method of claim 1, wherein the ejector refrigeration circuit further comprises:

at least one refrigeration expansion device having an inlet side, which is fluidly connected to the liquid outlet of the receiver, and an outlet side; and at least one refrigeration evaporator fluidly connected between the outlet side of the at least one refrigeration expansion device and the secondary low pressure input ports of the controllable ejectors.

3. The method of claim 1, wherein the method includes operating at least one of the controllable ejectors with its secondary low pressure input port being closed.

4. The method of claim 3 including opening the secondary low pressure input port of the at least one controllable ejector which has been operated with its secondary low pressure input port being closed.

5. The method of claim 4 wherein the secondary low pressure input port is opened gradually.

6. The method of claim 1 including closing the secondary low pressure input port of the first ejector.

7. The method of claim 1 including closing the primary high pressure input port of the first ejector.

8. The method of claim 7 including closing the secondary low pressure input port of the first ejector.

9. The method of claim 1 including using carbon dioxide as refrigerant.

10. An ejector refrigeration circuit, which is configured for circulating a refrigerant and comprises:

at least two controllable ejectors connected in parallel and respectively comprising a controllable motive nozzle, a primary high pressure input port forming an inlet to the controllable motive nozzle, a secondary low pressure input port and an output port;

a heat rejecting heat exchanger/gas cooler having an inlet side and an outlet side, the outlet side of the heat rejecting heat exchanger/gas cooler being fluidly connected to the primary high pressure input ports of the ejectors;

a receiver, having a liquid outlet, a gas outlet and an inlet, which is fluidly connected to the outlet ports of the controllable ejectors;

at least one compressor having an inlet side and an outlet side, the inlet side of the at least one compressor being fluidly connected to the gas outlet of the receiver, and the outlet side of the at least one compressor being fluidly connected to the inlet side of the heat rejecting heat exchanger/gas cooler; and a control unit, which is configured for operating the ejector refrigeration circuit employing a method comprising:

a) operating a first ejector of the at least two controllable ejectors by controlling the opening degree of its high pressure port until the maximum efficiency of said first ejector has been reached or the actual refrigeration demands are met;

b) operating a second ejector of the at least two controllable ejectors by gradually opening its primary high pressure input port for increasing the refrigeration capacity of the ejector refrigeration circuit in case the actual refrigeration demands are not met by operating the first ejector alone.

11. The ejector refrigeration circuit of claim 10 further comprising:

at least one refrigeration expansion device having an inlet side, which is fluidly connected to the liquid outlet of the receiver, and outlet side; and at least one refrigeration evaporator fluidly connected between the outlet side of the at least one refrigeration expansion device and the secondary low pressure input ports of the controllable ejectors.

12. The ejector refrigeration circuit of claim 10, wherein the controllable ejectors are provided with the same capacity.

13. The ejector refrigeration circuit of claim 10, wherein the controllable ejectors are provided with different capacities.

14. The ejector refrigeration circuit of claim 10, wherein a controllable valve is provided upstream the secondary low pressure input port of at least one/each of the controllable ejectors.

15. The ejector refrigeration circuit of claim 10, wherein at least one sensor, which is configured for measuring the pressure and/or the temperature of the refrigerant, is provided in at least one of a high pressure input line fluidly connected to the primary high pressure input ports, a low pressure input line fluidly connected to the secondary low pressure input ports and an ejector output line fluidly connected to the output ports of the controllable ejectors, respectively.

16. The ejector refrigeration circuit of claim 10, wherein at least one service valve is provided upstream of the controllable ejectors' primary high pressure input ports.

17. The ejector refrigeration circuit of claim 16 further comprising at least one low temperature circuit which is connected between the liquid outlet of the receiver and the inlet side of the at least one compressor and comprises in the direction of flow of the refrigerant:

at least one low temperature expansion device;

at least one low temperature evaporator; and at least one low temperature compressor.

18. The ejector refrigeration circuit of claim 10, wherein the refrigerant comprises carbon dioxide.

* * * * *